US011190887B2

(12) United States Patent
Frei et al.

(10) Patent No.: US 11,190,887 B2
(45) Date of Patent: Nov. 30, 2021

(54) FITTING AND POSITIONING A COMPONENT FOR A HEARING DEVICE

(71) Applicant: Sonova AG, Staefa (CH)

(72) Inventors: Christian Frei, Stäfa (CH); Thomas Winkler, Stäfa (CH)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/757,441

(22) PCT Filed: Nov. 3, 2017

(86) PCT No.: PCT/EP2017/078125
§ 371 (c)(1),
(2) Date: Apr. 20, 2020

(87) PCT Pub. No.: WO2019/086119
PCT Pub. Date: May 9, 2019

(65) Prior Publication Data
US 2021/0195348 A1 Jun. 24, 2021

(51) Int. Cl.
*H04R 25/00* (2006.01)

(52) U.S. Cl.
CPC ..... *H04R 25/602* (2013.01); *H04R 25/604* (2013.01); *H04R 25/652* (2013.01);
(Continued)

(58) Field of Classification Search
CPC ..... H04R 25/602; H04R 2225/31; H04R 2225/33
(Continued)

(56) References Cited

U.S. PATENT DOCUMENTS 3,123,678 A 3/1964 Prentiss et al.
4,941,180 A * 7/1990 Buettner ..... H04R 25/602 381/323
(Continued)

FOREIGN PATENT DOCUMENTS

CN 202077179 U 12/2011

OTHER PUBLICATIONS

European Patent Office, International Searching Authority, International Search Report for PCT/EP2017/078125, dated May 9, 2019, Rijswijk, Netherlands.

*Primary Examiner* — Suhan Ni
(74) *Attorney, Agent, or Firm* — ALG Intellectual Property, LLC

(57) ABSTRACT

The disclosed technology generally relates to a hearing device positioned partially or completely within an ear canal. In some implementations, the hearing device is an ITE with an oval-shaped or elongated battery, where the battery is positioned at an angle relative to a faceplate of the ITE. The hearing device can be a rechargeable, where the rechargeable battery is positioned (e.g., titled) between at an angle between 10 to 25 degrees relative to the faceplate of the ITE. In some implementations, the faceplate of the ITE is configured to enable the battery to pivot or adjust its angle such that the battery position can be adjusted to use space more efficiently. In some implementations, the battery 220 has a long axis, where the long axis is longer than any other battery axis, and the long axis extends from the faceplate at a non-perpendicular angle (e.g., 10 to 35 degrees).

8 Claims, 5 Drawing Sheets

(52) U.S. Cl.
CPC ..... *H04R 25/658* (2013.01); *H04R 2225/025* (2013.01); *H04R 2225/31* (2013.01); *H04R 2225/51* (2013.01); *H04R 2225/77* (2013.01)

(58) Field of Classification Search
USPC ..... 381/323, 382, 328
See application file for complete search history.

(56) References Cited

U.S. PATENT DOCUMENTS

| | | | | |
|---|---|---|---|---|
| 6,567,527 | B1 | 5/2003 | Baker | |
| 6,751,327 | B1 | 6/2004 | Urso et al. | |
| 6,993,142 | B2 * | 1/2006 | Bordewijk | H04R 25/602 381/322 |
| 8,605,927 | B2 * | 12/2013 | Fretz | G06K 7/109 381/328 |
| 2004/0107080 | A1 | 6/2004 | Deichmann et al. | |
| 2016/0080872 | A1 * | 3/2016 | Shennib | H04R 25/48 381/323 |

* cited by examiner

FITTING AND POSITIONING A COMPONENT FOR A HEARING DEVICE

TECHNICAL FIELD

The disclosed technology generally relates to a hearing device positioned partially or completely within an ear canal, where the battery for the hearing device has an oval shape and is angled to more efficiently use space within the hearing device. The disclosed technology also includes a method for fitting and positioning hearing device components.

BACKGROUND

The human ear and ear canal can have many different shapes and sizes, including small and tortuous spaces. Because of these geometric features, it is problematic to fit hearing devices for human ears. For example, FIG. 1 shows an ear 100 with a concha 105 and an ear canal 110 that has varying widths and contours. The lateral side of the ear 100 is away from the ear canal 110 to the right and the distal side is closer to an ear drum 115 (left side of FIG. 1A). Between the concha 105 and through the ear canal 110, a hearing device or components of a hearing device can be positioned. An aperture zone 125, an area open for fitting ear components, has varying degrees of width as shown by the differences in widths between openings 120*a* and 120*b* of the ear canal 110.

Because of geometry, it is challenging to comfortably fit a hearing device in the ear 100. Also, even if a hearing device fits comfortably within the ear canal 110, a hearing device user prefers not to have the hearing device protrude from the ear such that it is visible to others. The appearance of a hearing device can draw unwanted stigma or attention.

One hearing device is an in-the-ear hearing device (also referred to as "ITE"). As shown in FIG. 1B, ITE 130 includes a circular battery 170, a transducer 140 (e.g., speaker), microphone 150, a user control 155, a faceplate 160 (schematically illustrated, it projects out from the ear canal because it is bulky), a processor 145, and receiver tube or outlet to a small hole 190 to enable sound to be transmitted to the ear drum 115. As shown by the guidelines 180 and 185, the faceplate 160 and the components of the ITE 130 are generally perpendicular to each other and the components elongate in the distal direction of the ear drum 115 at approximately 90 degrees relative to the faceplate. The U.S. Pat. No. 6,879,697 discloses such an ITE device with a circular battery.

Even though this solution provides enhanced audio to a user and partially fits inside of an ear canal, the ITE still protrudes from the ear at a large distance and draws visual attention. For example, FIG. 1C shows a top view of the ITE device. The ITE device has a battery door 175 that protrudes from the faceplate out from the ear (i.e., laterally). The battery door 175 also includes a door and hinge 195 that add additional width to the ITE 130. The ITE fails to efficiently use space in positioning hearing device components. Accordingly, there exists a need for a hearing device that protrudes less from the ear and uses space more efficiently.

BRIEF DESCRIPTION OF THE DRAWINGS

The disclosure and accompanying figures disclose some implementations of the disclosed technology.

DETAILED DESCRIPTION

Figure 1A:
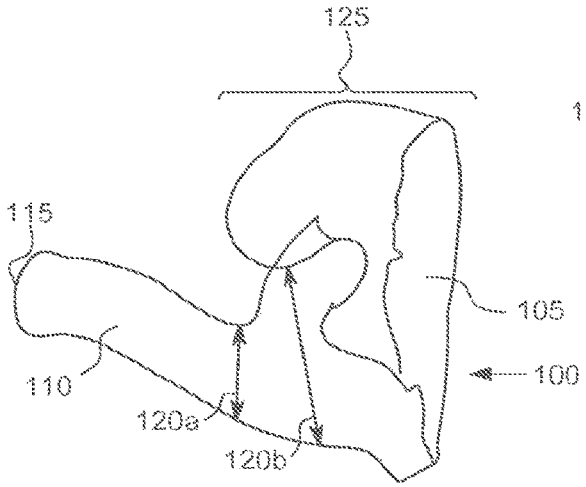
FIG. 1A (PRIOR ART)
FIG. 1A is a perspective view of a human ear.
Figure 1B:
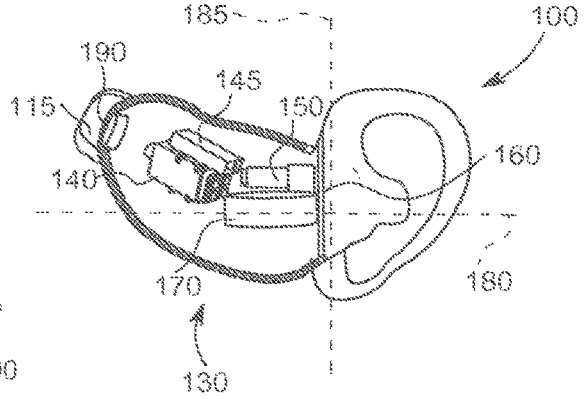
FIG. 1B (PRIOR ART)
FIGS. 1B-1D are perspective views for an in-the-ear (ITE) hearing device inserted into the human ear.
Figure 1C:
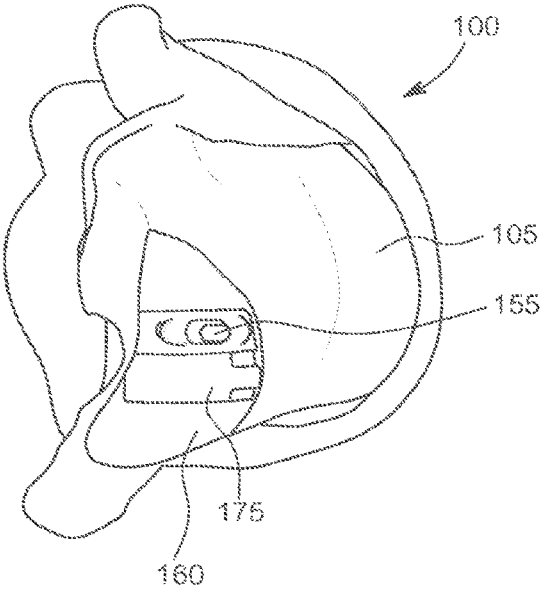
FIG. 1C (PRIOR ART)
Figure 1D:
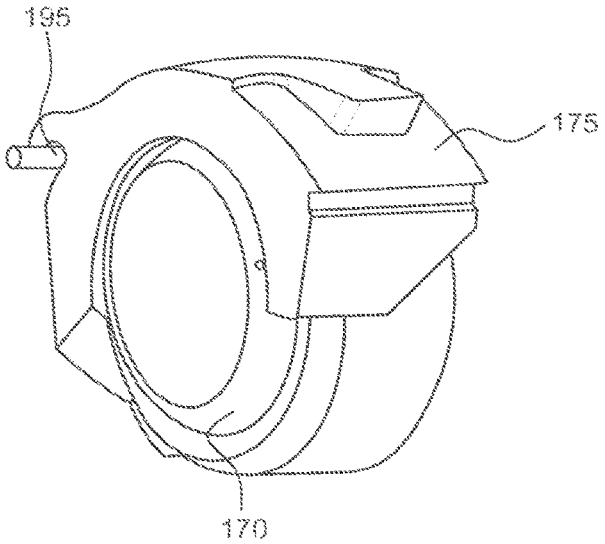
FIG. 1D (PRIOR ART)

The disclosed technology generally relates to a hearing device positioned partially or completely within an ear canal. In some implementations, the hearing device is an ITE with an oval-shaped or elongated battery, where the battery is positioned at an angle relative to the hearing device faceplate. The oval-shaped or elongated battery can be formed by a long axis of the battery, where the long axis is longer than other axes of the battery. For example, the hearing device can include a rechargeable oval-shaped battery inside of an ITE, where the rechargeable battery is positioned (e.g., tilted, slanted) between 10 to 25 degrees relative to the faceplate of the ITE.

In some implementations, the faceplate of the ITE is configured to enable the battery to pivot or adjust its angle. For example, the faceplate can have a curved inner surface to enable an oval-shaped battery to be positioned along the curved surface of a slot of the faceplate.

To fit the components of the hearing device into an ITE, the disclosed technology can use a process. The process generally includes receiving custom ear mold data or ear shape data from a measurement (e.g., computer or instrument measure). Then determining a position of the battery between an angle of 10 to 25 degrees based on the received ear shape data, where determining includes positioning the battery at an angle to improve (e.g., optimize) the space and geometry of the hearing device the ear shape. And the disclosed technology can provide a suggested position for the battery for a hearing device manufacturer.

In some implementations, the disclosed technology has at least one benefit. For example, the disclosed technology improves space efficiency for the ITE because the battery is positioned at an angle (e.g., 15 degrees) and oval-shaped so that the battery can extend farther into the ear canal instead of expanding across the ear canal. With this more efficient use of space, other components of the ITE can fit into a small space and the overall size of the ITE is reduced. Because the size of the ITE is reduced, the ITE can have a reduced profile and be less visible. Additionally, the vent of the ITE can positioned along the side of the ITE and the antenna of the ITE can be positioned on top of the device to enable wireless communication. The venting positioned along the side of the ITE and following a similar shape of the ear canal anatomy is naturally angled towards the faceplate at an angle of less than 90°. More generally, any component mounted vertically onto the faceplate may risk colliding with the venting. Angling the components themselves to an angle close to the venting angle will reduce the risk of collision, e.g., between antenna and venting.

The ITE does not have a battery door or battery door hinge, and the lack of these components further reduces the profile of the ITE protruding from the ear. The ITE also has a smooth outer surface without the battery door, and this results in an aesthetically pleasing appearance. Additionally, the disclosed technology has an oval-shaped battery at an angle and that is better for fitting an ITE to an ear. For example, with traditional circular batteries that were perpendicular to the faceplate, the circular batter shape and angle causes the battery to get "stuck" or block the entry of the ear canal and does not allow the faceplate to go deeper into the ear, even if there is enough space for the components of the hearing device. In contrast, the oval-shaped battery is slimmer and its angled position enables it to go deeper into the ear and allow more space for other components at the entrance of the ear (e.g., the vent).

Figure 2A:
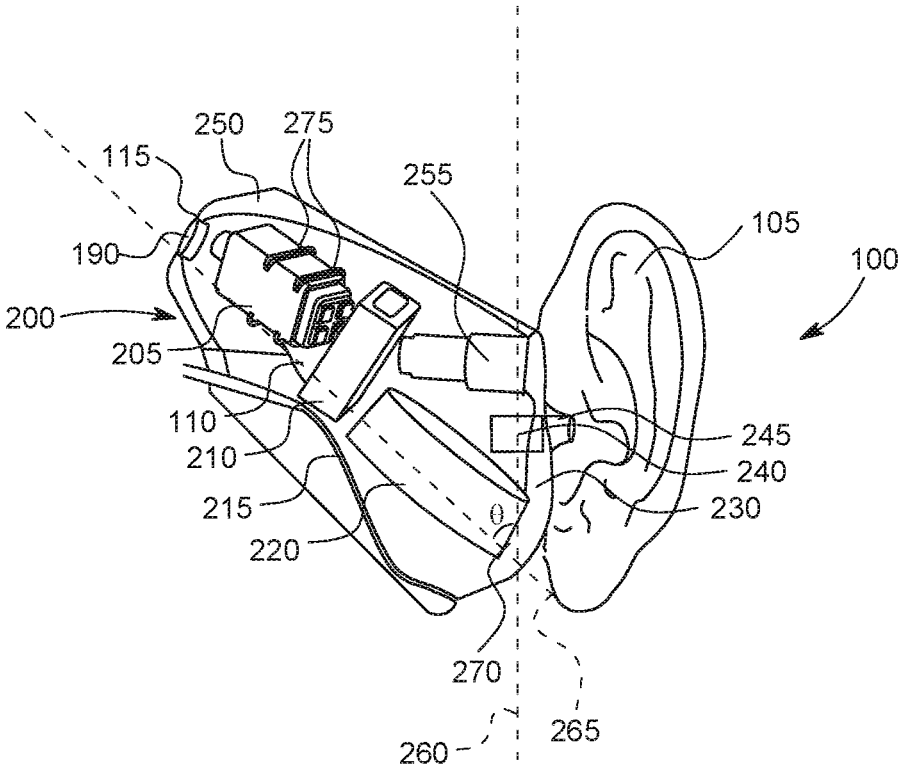
FIGS. 2A-2B are schematic views of a hearing device from the side and top in accordance with some implementations of the disclosed technology.
Figure 2B:
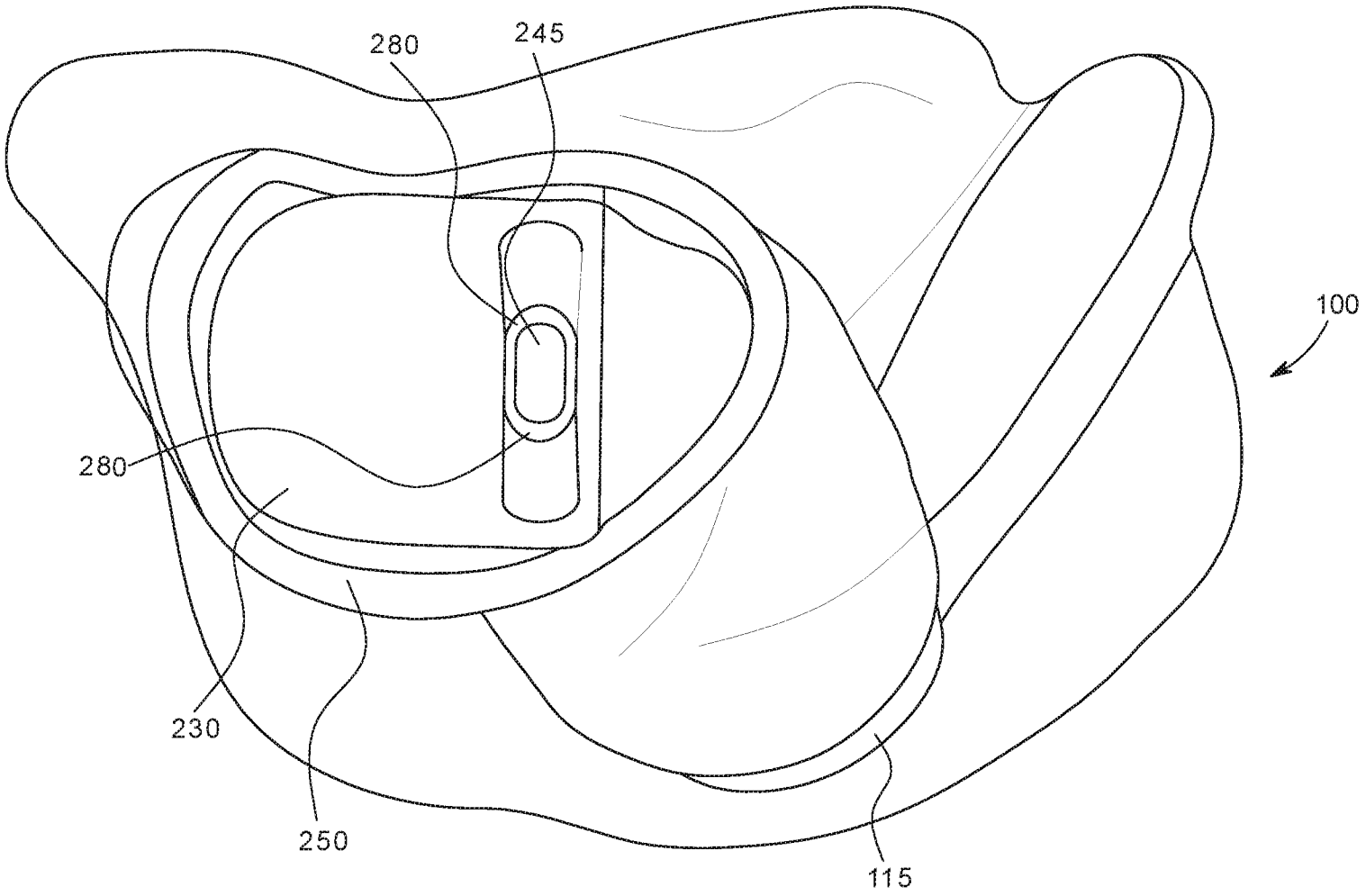

FIGS. 2A-2B are schematic views of a hearing device 200. FIG. 2A includes the ear concha 105, the ear drum 115, and the hearing device 200. The hearing devices 200 can be a prescription device or non-prescription device configured to be worn in or proximate to an ear. For example, the hearing device 200 can be an ITE that provides audio to a user. The hearing device 200 includes a transducer 205 that can be a speaker or other transducer that provides audio to the ear drum 115. The transducer 205 can include suspension 275 that assist in reducing vibration of the transducer 205, which may cause internal feedback if the microphone receives the vibration.

The hearing device 200 also includes a processor 210. The processor 210 can include special-purpose hardware such as application specific integration circuits (ASICS), programmable logic devices (PLDs), field-programmable gate arrays (FPGAs), programmable circuitry (e.g., one or more microprocessors microcontrollers), Digital Signal Processor (DSP), appropriately programmed with software and/or firmware, or a combination of special purpose hardware and programmable circuitry. In some implementations, the processor 210 is physically and electronically coupled to memory such as volatile memory, nonvolatile memory and dynamic memory, wherein the memory stores algorithms for providing sound to a user.

The hearing device 200 also includes a vent 215, a battery 220, a faceplate 230, a microphone 240, a switch 245, a shell wall 250, and an antenna 255. The shell wall 250 and the faceplate 230 coupled together can surround some components such as the battery 220, the transducer 205, where a small hole 190 in the shell wall 250 enables the transmission of sound. The vent 215 enables the flow of air between the inner and outer parts of the ear through the ITE, and the vent 215 can have curve to form to the ear canal.

Dashed guidelines 260 and 265 show an angle 270 of the battery 220. The battery 220 can be positioned at angle 270, where the angel is between 10 to 25 degrees to more efficiently use space within the hearing device 200. The angle 270 is non-perpendicular to the faceplate (e.g., does not have a 90 degree orientation relative to the faceplate). In some implementations, the angle 270 can be any angle less than 90 degrees. For example, the battery 220 can be positioned at 10, 15, 18, 22, or 25 degrees relative to the faceplate. Because the battery 220 is angled, the antenna 255 can be moved to opposite of the hearing device 200 (e.g., on top). The antenna 255 can communicate with the computing devices using Bluetooth™ (e.g., Bluetooth Classic™, Bluetooth Low Energy™), Zigbee™, WiFi™, other 802.11 wireless communication protocol, 10 MHz, HiBAN, or other 10-50 MHz binaural wireless communication between hearing devices.

Although not shown in FIG. 2A, the hearing device 200 include other components. For example, the hearing device 200 can include a reed-switch, a Tunneling Magnetoresistance (TMR), giant magnetoresistance (GMR), or other magnetic transducer configured to sense magnetic fields and change the operation of the hearing device based on the sensed magnetic field. For example, the magnet switch can be used to detect the presence of a smartphone or mobile device next to hear and cause the hearing device to communicate with the smartphone for communication purposes.

FIG. 2B shows the hearing device 200 from a different perspective. FIG. 2B illustrates a top view of the hearing device 200 with the switch 245, the shell wall 250, the faceplate 230, and the ear drum 115. From this top view, sound inlets 280 for the microphone 240 (FIG. 2A) are illustrated. The top view illustrates that hearing device 200 does not have a battery door or hinge, which was common in the prior art. The elimination of the battery door and hinge creates a smooth and aesthetically pleasing appearance, as well as reduces the width and size of the hearing device 200. Additionally, without the battery door and hinge, the hearing device 200 protrudes less from the ear than other devices with a battery door and hinge. Without a battery door or battery hinge, the faceplate 230 is a continuous piece of plastic and the exterior surface of the hearing device.

Figure 3A:
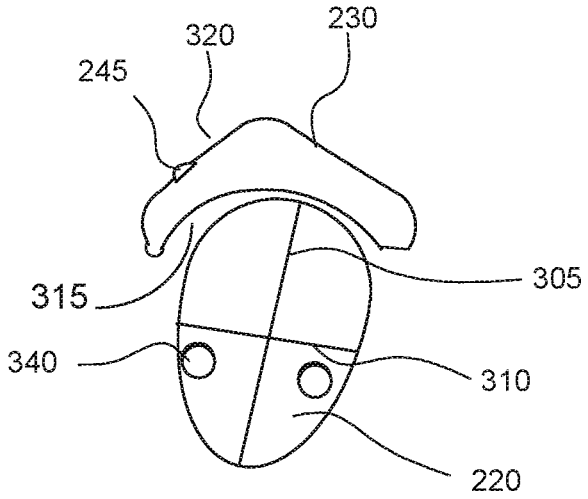
FIGS. 3A-3C are more detailed schematic views of a battery configuration for the hearing device from FIGS. 2A-2B in accordance with some implementations of the disclosed technology.
Figure 3B:
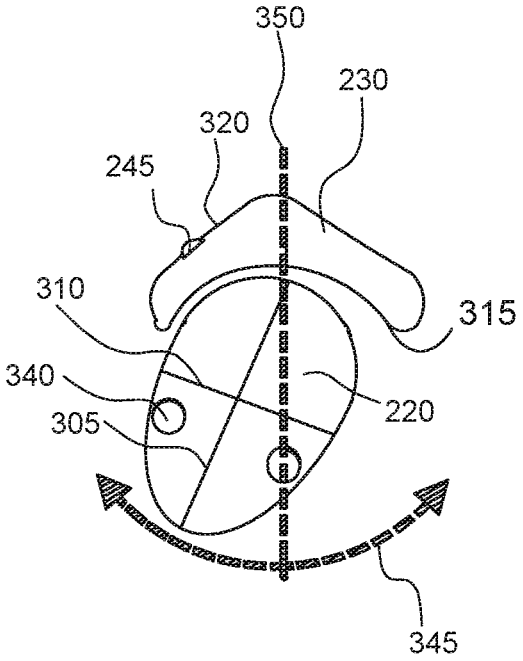
Figure 3C:
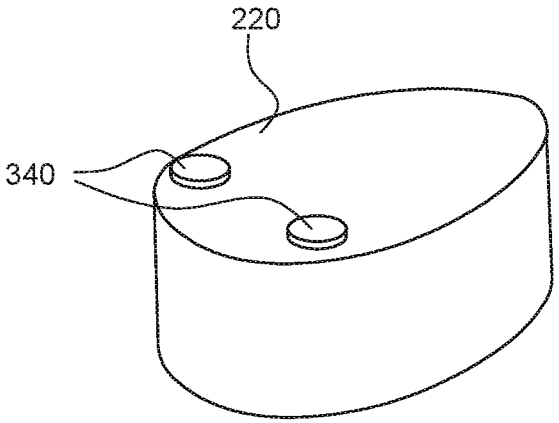

FIGS. 3A-3C are more detailed views of a battery configuration for the hearing device 200. FIG. 3A shows the faceplate 230 with a first side 315 and a second side 320. The first side 315 has a curved shaped that is generally fit so that the oval-shaped battery 220. In some implementations, the faceplate 230 is configured to be a cradle for holding or securing the battery 220 in place, where at least part of the battery is secured or physically coupled to the faceplate 230. In some implementations, a battery and faceplate are assembled together. For example, computer aided design (CAD) software can determine a position of the battery in the faceplate based partially on ear shape data, battery size data, and other components of the hearing device using a space optimization algorithm. The space optimization algorithm can be based on the size of the hearing device and available space within the device such that it fits comfortably within a human ear. In some implementations, an assembly technician fixes the battery to the faceplate into the required position by gluing or sealing it with a substance (e.g., silicone or similar) based on information from the CAD software.

The battery 220 has a first length 305 and a second length 310. In some implementations, the second length 310 is longer than the first length 305 such that the battery 220 protrudes further into the ear canal 110 and towards the ear drum 115, which reduces the width of the ITE because the battery is not circular or block shaped. The second length 310 is also referred to as the "long axis", wherein the long axis has a length greater than any other axis for the battery. Guidelines 345 and 350 are included for reference to show that the battery 220 can move left or right and have a different rotation angle. In some implementations, the battery 220 has height of 9.927 mm, a width of 4.280 mm, and a depth of 6.5 mm. The battery 220 size can vary based on size of hearing device, desired power or properties of battery, and shape of batter (e.g., curvature). In some implementations, the battery can range from 1 mm to 15 mm in each dimension.

FIG. 3C illustrates the battery 220 with contact pads or battery leads 340. The leads 340 can be used to electronically connect the battery 220 to the hearing device 200. The leads can vary in size from less than 0.2 mm or larger than 0.2 mm (e.g., 0.3 mm, 0.4 mm., 0.5 mm, or larger). The leads 340 can be placed anywhere on the battery 200 and be configured to power the hearing device 200.

Figure 4:
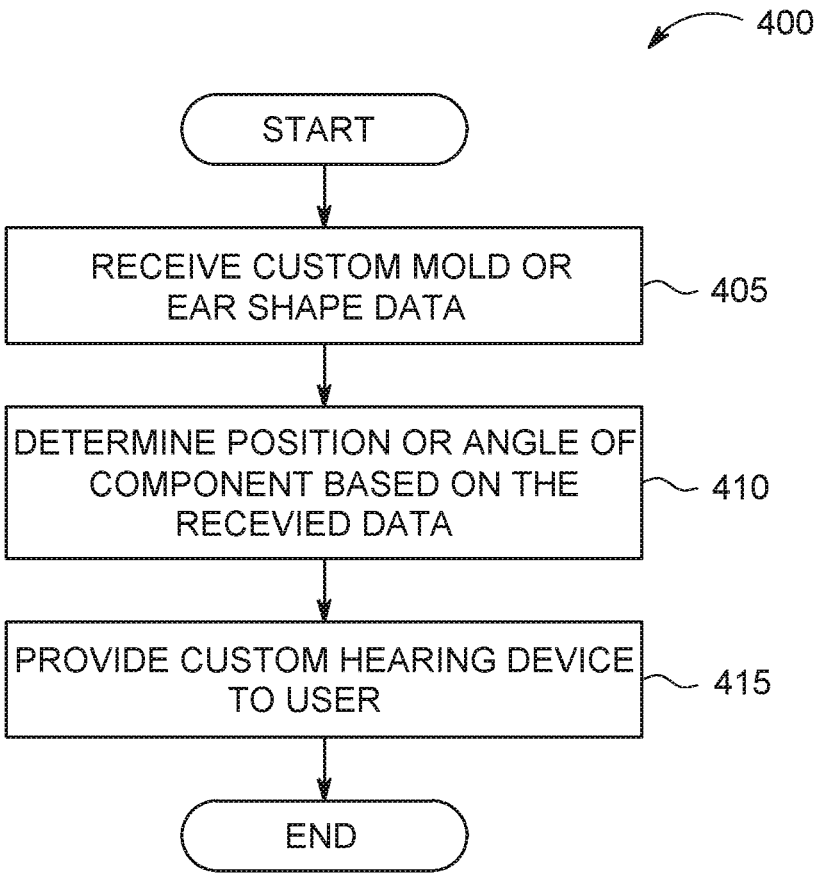
FIG. 4 is a block flow diagram for a fitting process for a hearing device component in accordance with some implementations of the disclosed technology.

FIG. 4 is a block flow diagram for a hearing device component fitting process 400. The process 400 includes receiving information about an ear size and shape (e.g., including the ear canal), determining an optimal position for a hearing device component in the hearing device, and providing instructions for installing the component. The process 400 can be started by an engineer or manufacturer technician, e.g., in laboratory or on a hearing aid assembly line.

At operation 405, a computing device receives a custom mold of an ear or ear shape data. For example, an individual can visit a hearing care center and a hearing care professional can take a mold of the individual's ear using a molding technology. Alternatively, the hearing care professional can take measures or use a camera/video camera to collect data for an individual's ear. The hearing care professional can store this information on a local computer or send the information to a cloud storage service. In some implementations, the hearing care professional can place the ear mold into a fitting machine that measures the geometry of the ear using lasers or other sensor devices. More generally, an individual's ear shape and size, including ear canal data, is stored or sent to another computing device.

At operation 410, a computing device determines a position for a hearing device component. For example, the computing device can receive data that includes the width of an individual's ear canal and shape of the individual's ear canal. Based on this received data, the computing device can determine that an optimal angle for an oval-shaped battery with an ITE for the individual should have an angle of 18 degrees relative to the faceplate. For example, the computing device can determine the length, width, and shape of a person's ear canal based on the received data, and then it can use trigonometry to determine an angle for a battery. In some implementations, a hearing aid modeling software defines an angle based on optimized position for battery and a person's ear. For example, a gauge can be used to position to battery within the hearing device.

At operation 415, the computing device can provide the determined position to a hearing care professional, 3D printer, or manufacturing process. The receiving party can use the determined information to manufacture the hearing device where the hearing device components is positioned at a particular angle (e.g., the battery is at 16 degrees relative to the faceplate).

After operation 415, the process 400 ends. In some implementations, the process 400 can be repeated for each ear of a person or repeated for multiple ears. The process 400 can also collect data from each determined optimal position and send this information to a center database for analysis.

Conclusion

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof means any connection or coupling, either direct or indirect, between two or more elements; the coupling or connection between the elements can be physical, logical, electromagnetic, or a combination thereof. Additionally, the words "herein," "above," "below," and words of similar import, when used in this application, refer to this application as a whole and not to any particular portions of this application. Where the context permits, words in the above Detailed Description using the singular or plural number may also include the plural or singular number respectively. The word "or," in reference to a list of two or more items, covers all of the following interpretations of the word: any of the items in the list, all of the items in the list, and any combination of the items in the list.

The teachings of the technology provided herein can be applied to other systems, not necessarily the system described above. The elements and acts of the various examples described above can be combined to provide further implementations of the technology. Some alternative implementations of the technology may include not only additional elements to those implementations noted above, but also may include fewer elements. For example, the technology can apply to a conference room with multiple microphones or an open space with users each holding or carrying a smart phone.

The terms used in the following claims should not be construed to limit the technology to the specific examples disclosed in the specification, unless the above Detailed Description section explicitly defines such terms. Accordingly, the actual scope of the technology encompasses not only the disclosed examples, but also all equivalent ways of practicing or implementing the technology under the claims.

To reduce the number of claims, certain aspects of the technology are presented below in certain claim forms, but the applicant contemplates the various aspects of the technology in any number of claim forms. For example, while only one aspect of the technology is recited as a computer-readable medium claim, other aspects may likewise be embodied as a computer-readable medium claim, or in other forms, such as being embodied in a means-plus-function claim.

The techniques, algorithms, and operations introduced here can be embodied as special-purpose hardware (e.g., circuitry), as programmable circuitry appropriately programmed with software and/or firmware, or as a combination of special-purpose and programmable circuitry. Hence, embodiments may include a machine-readable medium having stored thereon instructions which may be used to program a computer (or other electronic devices) to perform a process. The machine-readable medium may include, but is not limited to, floppy diskettes, optical disks, compact disc read-only memories (CD-ROMs), magneto-optical disks, ROMs, random access memories (RAMs), erasable programmable read-only memories (EPROMs), electrically erasable programmable read-only memories (EEPROMs), magnetic or optical cards, flash memory, or other type of media/machine-readable medium suitable for storing electronic instructions. The machine-readable medium includes non-transitory medium, where non-transitory excludes propagation signals. For example, a processor can be connected to a non-transitory computer-readable medium that stores instructions for executing instructions by the processor.

Also, the figures are not drawn to scale and have various viewpoints and perspectives. Some components or operations shown in the figures may be separated into different blocks or combined into a single block for the purposes of discussion of some implementations of the disclosed technology (e.g., the battery can be combined with the charging circuit in FIG. 2A). Although the disclosed technology is amenable to various modifications and alternative forms, specific implementations have been shown by way of example in the figures and are described in detail below. The intention, however, is not to limit the disclosed technology to the particular implementations. Rather, the disclosed technology is intended to cover all modifications, equivalents, and alternatives falling within the scope of the disclosed technology as defined by the appended claims. For example, although the hearing device 200 can a hearing aid it can also be an insertable earbud or a hearing device worth in the earn for people without hearing loss.

Example Implementations

The following examples are implementations of the disclosed technology. In some implementations, the disclosed technology includes a hearing device, the hearing device comprising: a faceplate; a shell physically coupled to the faceplate; a battery disposed proximate to the tube, wherein the battery has a long axis, wherein the battery is positioned such that the long axis is at an angle non-perpendicular to the faceplate, wherein the shell and faceplate completely surround the battery. The battery can have two axes, where one is long than the other. The longer axis creates an oval shaped battery, where the ratio of one axis to other axis is such that an oval shaped battery is formed. The hearing device battery can have a first and second side, and wherein the hearing device further comprises: an antenna, wherein the antenna is disposed farther away from the first side than the second side; and a microphone, wherein the microphone disposed farther away from the first side than the second side. The hearing device angle can be between 10 to 28 degrees or less than 90 degrees (e.g., non-perpendicular). Additionally, the hearing device angle can be 15 degrees and the faceplate can be a continuous piece of plastic and the exterior surface of the hearing device, where exterior surface is the outermost surface of the battery (including battery casing). The hearing device can further comprises an antenna; a switch; a processor; a microphone; and a transducer, wherein the processor is disposed between the transducer and the antenna. And the hearing device battery can be a rechargeable battery. The hearing device can also include a tube forming a vent proximate to the faceplate.

For orientation, the hearing device faceplate can have a first and second side, and wherein the second side of the faceplate includes a curved edge to enable the placement of the battery at an angle, and wherein the faceplate surrounds components of the hearing device without a battery door, and wherein the faceplate forms an opening a microphone and is configured to carry an antenna. The battery can include two pads or contacts for electronically coupling the battery with the hearing device, and wherein the hearing device is an in-the-ear hearing device configured to partially protrude from an ear canal.

The disclosed technology also includes a method for positioning a battery in a hearing device, the method comprising: receiving data for an ear shape; determining an angle for the battery in a hearing device based on the received data; and providing the determined angle for the battery to a hearing aid professional or manufacturing process for the hearing device, wherein the angle is associated with a long axis of a battery and the long axis is longer than any other battery axis. The battery can be configured to fit with a faceplate for the hearing device. The angle can be between 10 to 25 degrees. The received data for the ear shape can be based on receiving a custom mold for the hearing device or a partial scan of the ear.

The method can also be executed by a hearing manufacturer using a device (e.g., computing device), where the device has a non-transitory computer-readable medium storing instructions that when executed by a processor cause the device to perform operations to provide a design for a hearing device, the operations comprising: receiving data for an ear shape; determining an angle for the battery in a hearing device based on the received data; and providing the determined angle for the battery to a hearing aid professional or manufacturing process for the hearing device, wherein the angle is associated with a long axis of a battery and the long axis is longer than any other battery axis. The battery can be configured to fit with a faceplate for the hearing device. The angle can be between 10 to 25 degrees. The received data for the ear shape can be based on receiving a custom mold for the hearing device or a partial scan of the ear. The non-transitory computer-readable medium can also store instructions for determining the angle of the battery partially based on computer aid design software that is configured to execute a space optimization algorithm for the hearing device.

What is claimed:

1. A hearing device comprising:

a faceplate comprising a first side and a second side provided opposite to the first side, the first side of the faceplate configured to receive a battery, the second side of the faceplate corresponding to an exterior surface that is configured to face away from a skull of a user of the hearing device while the hearing device is worn by the user;

a shell physically coupled to the faceplate; and the battery, wherein the battery has a long axis, wherein the battery is positioned such that the long axis is at an angle non-perpendicular to the second side of the faceplate, wherein the shell and faceplate completely surround the battery.

2. The hearing device of claim 1, wherein the battery has a first and second side, and wherein the hearing device further comprises:

an antenna, wherein the antenna is disposed farther away from the first side of the battery than the second side of the battery; and a microphone, wherein the microphone disposed farther away from the first side of the battery than the second side of the battery.

3. The hearing device of claim 1, wherein the angle is between 10 to 28 degrees, and the hearing device further comprises:

a tube forming a vent proximate to the faceplate.

4. The hearing device of claim 1, wherein the angle is 15 degrees and the faceplate is a continuous piece of plastic, wherein the exterior surface is an outermost surface for the hearing device.

5. The hearing device of claim 1, wherein the hearing device further comprises:

an antenna;

a switch;

a processor;

a microphone; and a transducer, wherein the processor is disposed between the transducer and the antenna.

6. The hearing device of claim 1, wherein the battery is a rechargeable battery and has an oval shape, wherein the oval shape is formed by the long axis and a short axis, and wherein the hearing device lacks a battery door.

7. The hearing device of claim 1, wherein the first side of the faceplate includes a curved edge to enable placement of the battery at an angle, and wherein the faceplate surrounds components of the hearing device without a battery door, and wherein the faceplate forms an opening fora microphone and the faceplate is configured to carry an antenna.

8. The hearing device of claim 1, wherein the battery includes two pads or contacts for electronically coupling the battery with the hearing device, and wherein the hearing device is an in-the-ear hearing device configured to partially protrude from an ear canal.

* * * * *